United States Patent [19]

Corbisiero

[11] Patent Number: 4,836,571

[45] Date of Patent: Jun. 6, 1989

[54] LENGTH-ADJUSTABLE TOY SKI

[76] Inventor: Salvatore Corbisiero, 3539 Bressani, Montreal, Quebec, Canada, H1Z 1H2

[21] Appl. No.: 163,291

[22] Filed: Mar. 2, 1988

[30] Foreign Application Priority Data

Mar. 6, 1987 [CA] Canada ..... 531317

[51] Int. Cl.[4] ..... A63C 9/08

[52] U.S. Cl. ..... 280/600; 36/97; 280/603

[58] Field of Search ..... 36/97, 117; 441/68; 280/600, 601, 603, 11.16

[56] References Cited

U.S. PATENT DOCUMENTS

| | | | |
|---|---|---|---|
| D. 232,044 | 7/1974 | King | 280/600 X |
| 1,526,904 | 2/1925 | Denning | 280/600 |
| 1,529,466 | 3/1925 | Curfman | 280/600 |
| 2,946,599 | 7/1960 | Hunsbedt | 280/600 |
| 4,160,301 | 7/1979 | Woolley | 36/132 X |

FOREIGN PATENT DOCUMENTS

| | | | |
|---|---|---|---|
| 133169 | 5/1933 | Austria | 280/600 |
| 3442292 | 5/1986 | Fed. Rep. of Germany | 280/600 |

*Primary Examiner*—David M. Mitchell
*Assistant Examiner*—Michael Mar
*Attorney, Agent, or Firm*—Steele, Gould & Fried

[57] ABSTRACT

A length-adjustable short ski for mounting on a boot. The ski has a sole-receiving portion and a heel-receiving portion. Each of these portions has a platform, the heel platform overlapping the sole platform, and the platforms are interconnected by tongue-and-groove joints allowing their relative sliding displacement and holding the portions in assembled condition, the grooves and tongues projecting downwardly from the platforms. Once the sole and heel portions have been set to the desired length of the ski, they are locked together. For this purpose, the sole end of the heel platform has a resilient tongue with a pair of ribs projecting downwardly and locking into two of a plurality of locking notches formed in the underlying sole platform.

12 Claims, 3 Drawing Sheets

FIG. 4
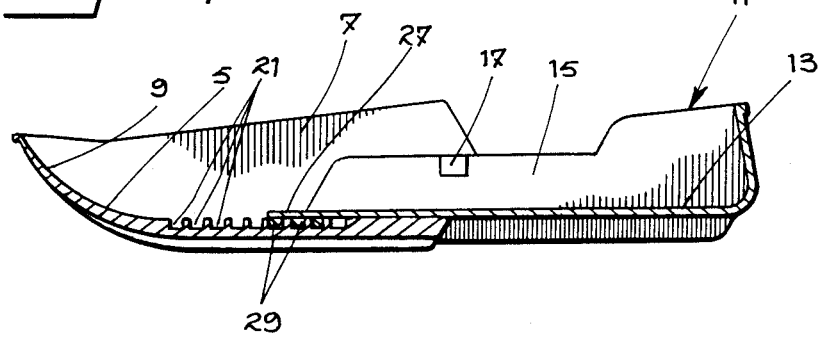
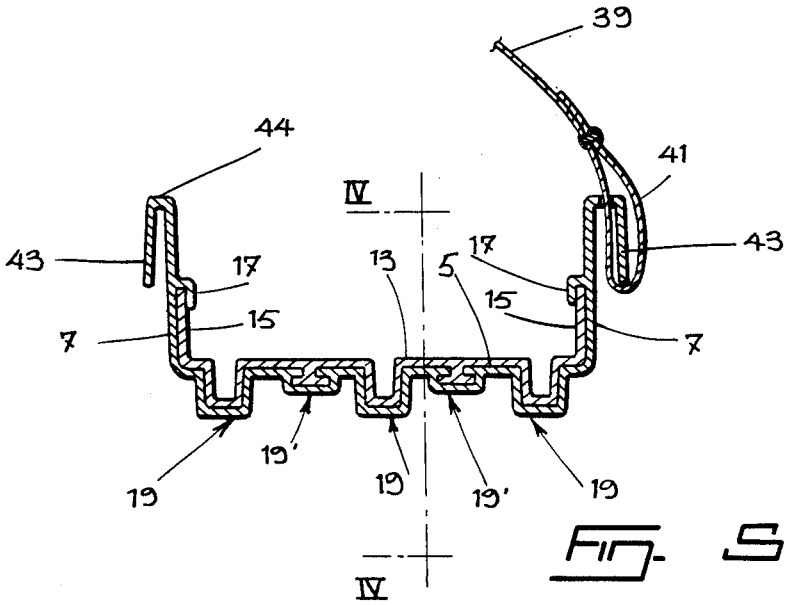
FIG. 5

LENGTH-ADJUSTABLE TOY SKI

BACKGROUND OF THE INVENTION

1. Field of the invention

The present invention relates to a toy ski for use particularly by children. It relates more generally to a length-adjustable short ski-like article for mounting on a boot.

2. Description of the prior art

Toy skis are already known for mounting on boots but they are made in predetermined non-adjustable lengths so that they can fit only on boots of corresponding lengths. In other words, these skis are not adjustable as to length and this is a great inconvenience. Also, conventional laces or buckled leather straps are used to mount the skis on the boots, which is another difficulty with young children, particularly in cold weather.

SUMMARY OF THE INVENTION

One object of the invention is to provide a toy of the above type which is adjustable as to length so that it can be mounted on boots of different lengths. More particularly, the ski of the invention has a sole-receiving portion and a heel-receiving portion. Means extending lengthwise of the portions, interconnect them in assembled condition and allow them to slide with respect to one another so that the same article can be made to fit on boots having different lengths. The ski also has a mechanism that releasably locks the two portions together when the desired length has been obtained.

In the preferred embodiment hereinafter described, the interconnecting means are elongated tongue-and-groove joints projecting downwardly from; the sole and heel portions. Some of the joints have straight tongues and grooves while the remaining joints have essentially dove-tailed tongues and grooves, particularly an inverted T shape.

Preferably also, the two ski portions each has its own platform with the heel platform overlapping the sole platform and the latter being formed with transverse locking notches spaced from one another lengthwise. The releasably locking mechanism than comprises a resilient tongue provided at the sole end of the heel platform, and at least one rib solid with and projecting from one face of the resilient tongue, being oriented and sized to engage in one of the grooves to lock the platforms together, and thus the two ski portions in the desired ski length.

Advantageously, the ski-like article further comprises a member supporting the back of the boot and means mounting one end of this support member to the rear end of the sole platform for pivotal movement of the member about a horizontal axis extending across the sole support end.

As mentioned previously, the means attaching the ski-like article to the boot should comprise elastic bands including VELCRO® locks, on the sole portion and on the support member, for attaching the sole portion over the vamp of the boot and for attaching the support member over the top of the boot, respectively.

Other features and advantages of the invention will be revealed by the description that follows of a preferred embodiment having reference to the appended drawings.

BRIEF DESCRIPTION OF THE DRAWINGS

FIG. 4 is a longitudinal cross section of the article taken along line IV—IV of FIG. 3 and IV—IV of FIG. 5, and FIG. 5 is a transverse cross section taken along line V—V of FIG. 3.

DESCRIPTION OF A PREFERRED EMBODIMENT

Figure 1:
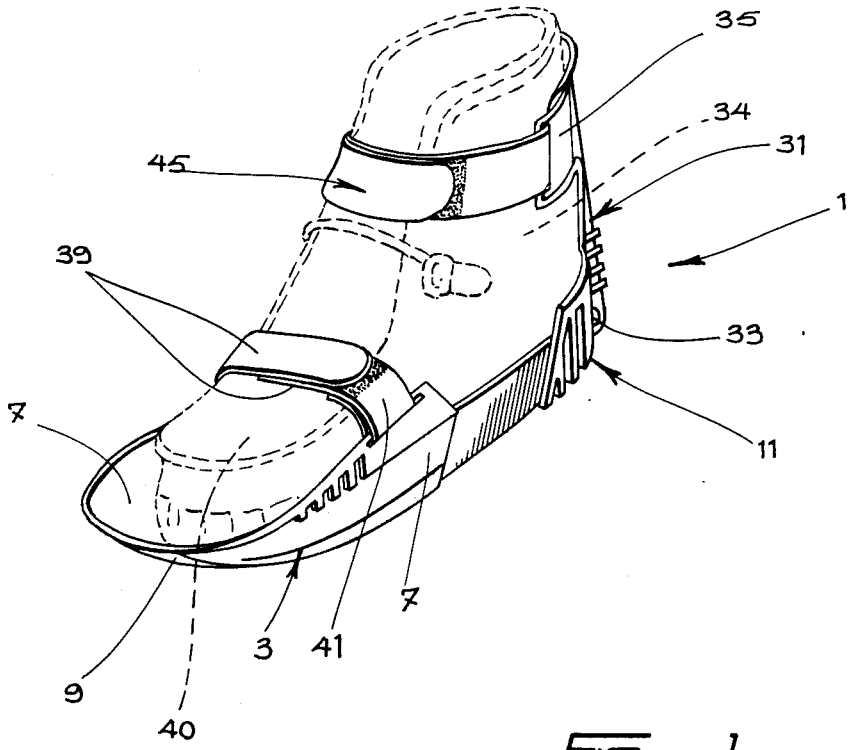
FIG. 1 is a perspective view of a ski-like article made according to the invention and shown mounted on a boot illustrated in phantom lines.
Figure 2:
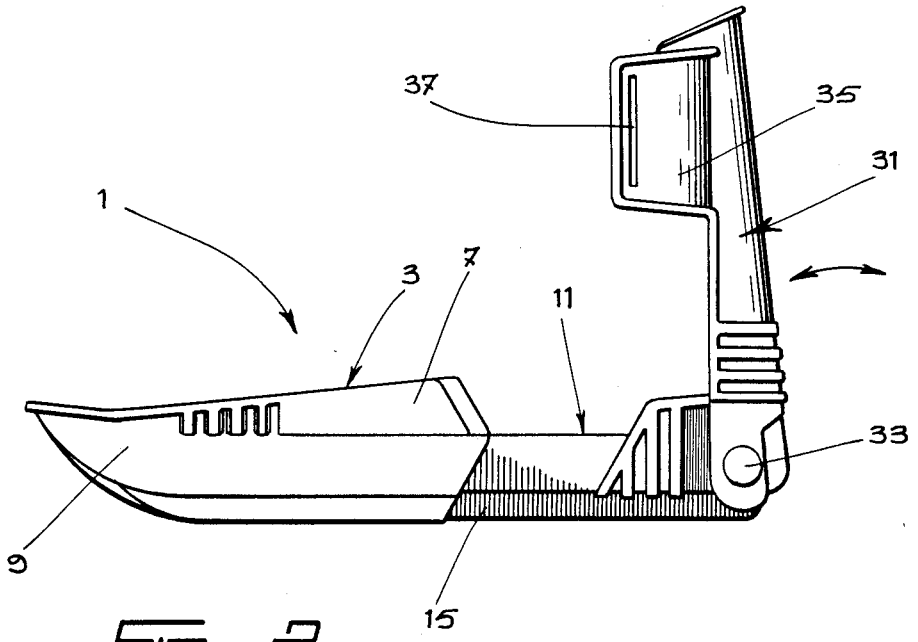
FIG. 2 is a side elevation view of the article of FIG. 1.

As shown, the ski-like article 1 has a front or sole-receiving portion 3 formed by a sole platform 5 (FIG. 3) merging with lateral upright flanges 7 of which the upper part may bend slightly inwardly, as best shown in FIG. 1. The platform 5 also merges with a nose 9 slightly inclined upwardly. A rear or heel-receiving portion 11 is likewise formed by a heel platform 13 of which the forward end overlaps the sole platform 5 (figure 4). The heel platform merges with lateral upright flanges 15 located inside the sole portion 3. Flanges 7 and 15 are held in contact during relative sliding displacement of the sole and heel portions 3 and 11, by short tabs 17 (FIGS. 4 and 5) of the sole portion 5.

As mentioned above, means that extend lengthwise of portions 3 and 11 interconnect them to hold them in assembled condition as well as to allow them to slide one in respect to the other. In this manner, the article 1 may be adjusted in length to fit the length of the boot on which it is proposed to mount it. In the shown embodiment, such means comprise joints 19, 19', of cooperating tongues and grooves that project downwardly from the platform 5, 13 (FIG. 5). The two outward joints and the central joint 19 are straight tongue-and-groove joints and serve to guide the sliding displacement of the sole and heel portions 5, 13. They may conveniently be slightly tapered. The intermediate joints 19' may be said to be essentially dove-tailed and serve additionally to hold the two portions 5, 13, in assembled condition. In the form shown, joints 19' have grooves and tongues of inverted T shape.

Figure 3:
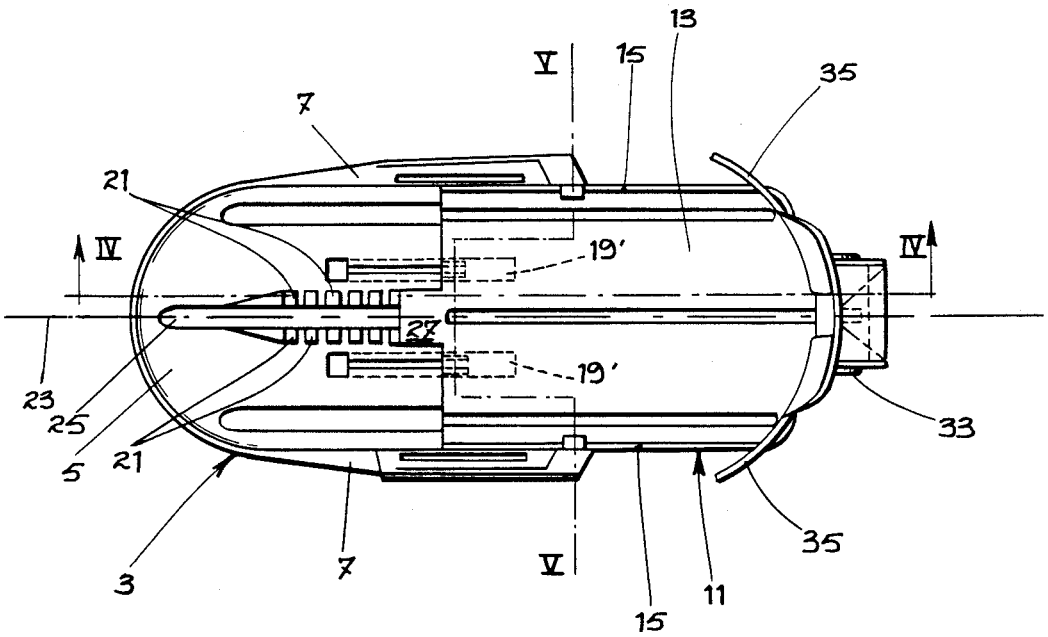
FIG. 3 is a top plan view.

As illustrated in FIGS. 3 and 4, the sole platform 5 is formed with transverse locking notches 21 spaced from one another lengthwise of platform 5, that is along its longitudinal axis 23, and also on either side of the groove 25 of the central joint 19. The means responsible for releasably locking the sole and heel portions 3 and 11 together, once the desired length of the ski-like article has been obtained, comprise of resilient tongue 27 provided at the forward or sole end of the heel platform 13 and short ribs 29 (FIG. 4) solid with and projecting from one face of the tongue 27. These ribs 29 are sized and oriented so that they easily fit into the notches 21 so as to prevent relative sliding displacement of the sole and heel portions, particularly of course when the ski article is attached to a child's boot. While one such rib 29 is sufficient, it is preferable to use two, or four as shown. The ribs should be rounded for easier movement from one notch 21 to the next; the resiliency of the tongue 27 ensuring that they be safely lodged in the notches 21 when properly positioned.

In order to support the back of the top 34 of the boot by connecting it to the heel portion, there is provided a support member 31 hinged, at its lower end, to the rear end of the heel portion 11 by a pivot joint 33. This support member is arcuate to follow the contour of the back of the top 34 of the boot and has curved lateral ears 35 at its upper end provided with belt slots 37. It is pivotable, through its pivot joint 33, about an axis transverse to the longitudinal axis 23.

The ski-like article is attached to the boot over its vamp 40 by elastic bands 39, each having a loop 41, at one end, winding around a downward leg 43 of one of the flanges 7 and extending through a slot 44 between the flanges 7 and its leg 43, as shown in FIGS. 1 and 5. The other ends of the bands 39 have cooperating parts of a known VELCRO® lock. A similar resilient band and VELCRO® lock arrangement 45 is provided for attaching the support member 31 to the top 34 of the boot, allowing the member to flex, when the child bends.

Alternatively the skin-like article may be attached to the boot by means of VELCRO® straps having a bead-shaped end used for locking them into the slots 44.

I claim:

1. A length-adjustable short ski for mounting on a boot, said ski comprising:

a front sole-receiving portion having a ground-engaging sole platform and a rear heel-receiving portion having a ground-engaging heel platform overlapping said sole platform;

means extending lengthwise of and interconnecting said portions to hold the said portions in assembled condition and for relative sliding displacement thereof for adjusting the length of said ski to an adjusted length corresponding to said boot for mounting said ski on said boot, said interconnecting means consisting of elongated tongue-and-groove joints projecting downwardly from said sole and heel platform, at least some of said joints being formed by tongue and grooves of essentially dovetail cross configuration, means releasably locking said portions in said adjusted length; and means for attaching said portion to said boot, whereby the ski presents a substantially unbroken ground-engaging platform extending the length of the ski in all adjusted lengths.

2. A ski as claimed in claim 1, wherein at least some other of said joints are formed by straight tongues and grooves.

3. A ski as claimed in claim 1, wherein said dovetail cross configuration is an inverted T shape.

4. A ski as claimed in claim 3, wherein some other of said joints are formed by straight tongues and grooves.

5. A ski as claimed in claim 4, wherein:

said sole portion has a sole platform and;

wherein said sole platform is formed with transverse locking notches spaced from one another lengthwise of said sole platform, and wherein said releasable locking means comprise:

a resilient tongue at the sole end of said heel platform and at least one rib solid with and projecting from one face of said resilient from one face of said resilient tongue, said rib being oriented and sized so as to engage in one of said notches.

6. A ski as claimed in claim 10, further comprising: a member for supporting the back of said boot and means mounting one end of said support member to the rear end of said sole platform for pivotal movement of said member about a horizontal axis extending across said sole support end.

7. A ski as claimed in claim 4, further comprising: a member for supporting the back of said boot and means mounting one end of said support member to the rear end of said sole platform for pivotal movement of said member about a horizontal axis extending across said sole support end.

8. A ski as claimed in claim 1, wherein:

said sole platform is formed with transverse locking notches spaced from one another lengthwise of said sole platform, and wherein said releasable locking means comprise:

a resilient tongue at the sole end of said heel platform and at least one rib solid with and projecting from one face of said resilient tongue, said rib being oriented and sized so as to engage in one of said notches.

9. A ski as claimed in claim 8, wherein said tongue is formed with two notch-engaging ribs.

10. A ski as claimed in claim 8, wherein said article further comprising: a member for supporting the back of said boot and means mounting one end of said support member to the rear end of said sole platform for pivotal movement of said member about a horizontal axis extending across said sole support end.

11. A ski as claimed in claim 1, comprising: a member for supporting the back of said boot and means mounting one end of said support member to the rear end of said sole platform for pivotal movement of said member about a horizontal axis extending across said sole support end.

12. A ski as claimed in claim 11, wherein said attaching means comprise: elastic bands including VELCRO® locks, on said sole portion and on said support member for attaching said sole portion over the vamp of said boot and for attaching said support member over the top of said boot, respectively.

* * * * *

UNITED STATES PATENT AND TRADEMARK OFFICE

CERTIFICATE OF CORRECTION

PATENT NO. : 4,836,571

DATED : June 6, 1989

INVENTOR(S) : Corbisiero

It is certified that error appears in the above-identified patent and that said Letters Patent is hereby corrected as shown below:

Column 1, line 36 after "downwardly from" delete "(;)".

Column 2, line 56 delete "of" and insert --a--.

Column 3, line 49 delete "other" and insert --others--.

Signed and Sealed this

Thirteenth Day of November, 1990

*Attest:*

HARRY F. MANBECK, JR.

*Attesting Officer*

*Commissioner of Patents and Trademarks*